United States Patent [19]

Alexander et al.

[11] 4,329,763

[45] May 18, 1982

[54] PROCESS FOR SOFTENING NONWOVEN FABRICS

[75] Inventors: Robert E. Alexander, Shelby, N.C.; Kenneth R. Baugh, Pensacola, Fla.

[73] Assignee: Monsanto Company, St. Louis, Mo.

[21] Appl. No.: 946

[22] Filed: Jan. 4, 1979

[51] Int. Cl.[3] ..... D04H 3/08

[52] U.S. Cl. ..... 28/104; 156/344; 427/354

[58] Field of Search ..... 28/104, 105, 167, 169; 427/354; 156/344

[56] References Cited

U.S. PATENT DOCUMENTS

| | | | |
|---|---|---|---|
| 3,620,903 | 11/1971 | Bunting et al. | 28/104 X |
| 4,005,566 | 2/1977 | Hawkins | 28/104 X |
| 4,075,383 | 2/1978 | Anderson et al. | 428/219 X |

*Primary Examiner*—Michael R. Lusignan
*Attorney, Agent, or Firm*—Thomas N. Wallin

[57] ABSTRACT

Bonded nonwoven fabrics are softened by impinging the fabrics with a fluid jet.

7 Claims, No Drawings

PROCESS FOR SOFTENING NONWOVEN FABRICS

BACKGROUND OF THE INVENTION

This invention relates to processes for softening bonded nonwoven fabrics. More specifically, the invention relates to such processes wherein softening is effected by impingement of the fabric with a fluid jet.

Nonwoven fabrics and numerous uses thereof are well known to those skilled in the textiles art. Such fabrics can be prepared by forming a web of continuous filament and/or staple fibers and bonding the fibers at points of fiber-to-fiber contact to provide a fabric of requisite strength. The term "bonded nonwoven fabric" is used herein to denote nonwoven fabrics wherein a major portion of the fiber-to-fiber bonding referred to is adhesive bonding accomplished via incorporation of adhesives in the web to "glue" fibers together or autogenous bonding such as obtained by heating the web or by the use of liquid or gaseous bonding agents (usually in conjunction with heating) to render the fibers cohesive. In effecting such bonding, particularly autogenous bonding, the web may be subjected to mechanical compression to facilitate obtaining adequate bonding.

Nonwoven fabrics which are strongly bonded overall (for example, by uniform compression of the entire web in the presence of heat and/or appropriate bonding agents) tend to be stiff and boardy and are frequently more similar to paper that to woven textile fabrics. In order to obtain softer non-woven fabrics more closely simulating woven fabrics, nonwoven "point bonded" fabrics have been prepared by processes which tend to limit bonding to spaced, discrete areas or points. This is accomplished by application or activation of adhesive or bonding agent and/or application of heat and/or pressure at the points where bonding is desired. For example, the web to be bonded can be compressed between a pair of rolls or platens at least one of which carries bosses or a land and groove design sized and spaced to compress the web at the desired points. The compression means can be heated to effect thermal bonding of the web fibers or to activate a bonding agent applied to the web. In the actual practice of preparing point bonded fabrics, however, it is frequently difficult or even impossible to limit bonding to the desired points. In many processes web areas between the desired bond points are subjected to sufficient heat, compression, activated bonding agent or adhesive to effect "tack" bonding of fibers outside the desired bond points. Such tack bonding is believed to contribute significantly to undesired fabric stiffness.

It has been found that most point bonded nonwoven fabrics, particularly those having a large number of tack bonds, and many overall bonded nonwoven fabrics can be significantly softened by subjecting the fabric to mechanical stress. For example, the fabric can be washed in conventional domestic washing machines; drawn under tension over a sharply angles surface such as a knife blade; stretched; twisted; crumpled; or subjected to various combinations of such treatments. Such treatments are believed to effect softening primarily by breaking weaker fiber-to-fiber bonds such as tack bonds which can be broken without breaking the bonded fibers.

Although the softening techniques referred to above are relatively effective, they are subject to certain practical problems. For example, drawing a nonwoven fabric over a knife blade with sufficient force to effect substantial softening frequently results in undesirably high physical damage to the fabric. Washing of nonwoven fabrics in conventional washing machines generally yields quite good results with respect to softening. However, washing processes of this type are normally batch operations not readily adaptable for use in continuous processes of the type employed commercially for production of nonwoven fabrics.

It is apparent, therefore, that a commercially practical process for the softening of nonwoven fabrics would satisfy a long-felt need in the nonwoven textile art.

SUMMARY OF THE INVENTION

It is an object of the present invention to provide processes for the softening of bonded nonwoven fabrics. These objects are obtained by impinging the fabric to be softened with a fluid jet so as to effect the desired degree of fabric softening. The practice of the invention will be understood from the following description of the preferred embodiments.

DESCRIPTION OF THE PREFERRED EMBODIMENTS

The process of the present invention can be utilized to effect softening of any softenable, bonded, nonwoven fabric. The phrase "softenable, bonded, nonwoven fabric" denotes a nonwoven fabric which is autogenously and/or adhesively bonded and which can be significantly softened (as evidenced by a reduction in bending modulus of at least 5%) by subjecting the fabric to one or more washings in conventional domestic washing machines (for example, a Kenmore Model 76431100 marketed by Sears, Roebuck and Co.) or by subjecting the fabric to physical stress such as stretching, twisting, crumpling, or the like. Of course, any fabric which can be softened to the requisite degree by the process of this invention will be a softenable fabric. It is believed that such nonwoven fabrics contain a substantial number of bonds sufficiently weak to be broken by such washing or stress without breaking the bonded fibers per se. The nonwoven fabric may be composed of natural or synthetic fibers either in the form of continuous filaments or staples or combinations thereof. The invention is particularly useful for softening of nonwoven fabrics of continuous filament nylon (e.g., nylon 66) autogenously bonded by the action of hydrogen chloride as described, for example, in U.S. Pat. No. 4,075,383. The invention is most effective when practiced with point-bonded fabrics, i.e., fabrics primarily bonded in spaced, discrete areas. Presumably this is due to the particularly high effectiveness of the process in breaking secondary or tack bonds outside of the primary bond sites.

It is generally desirable that the number of spaced, discrete bond sites per square centimeter be from 1 to 250, preferably from 16 to 64, and that such sites occupy from 2% to 80%, preferably 3% to 50%, most preferably 5% to 30% of the fabric surface.

In accordance with the present invention, softenable, bonded, nonwoven fabric is subjected to impingement with a fluid jet having characteristics selected to effect at least a 25%, preferably at least 50%, most preferably at least 70% softening of the fabric as measured by reduction in fabric bending modulus. The fluid jet employed will be a high energy jet of the type obtained by ejecting highly pressurized fluids through appropriate nozzles or orifices. It has been found efficacious and economical to employ water jets (actually a mixture of water and air which is entrained therewith as the water exits the jet forming orifice). It is contemplated, however, that a variety of liquid or gaseous fluids or mixtures thereof can be effectively utilized for the softening of various fabrics. The fluid selected should, of course, be chemically compatible with the fabric so as not to effect solution or chemical degradation thereof.

Those skilled in the art will recognize that fluid jet velocity, the size and shape of the jet stream, the amount of air entrained in the stream, etc., will be significantly affected by such considerations as design of the jet nozzle, fluid pressure, and the physical characteristics of the chosen fluid. Further, the softening effect of the jets on the fabric may be additionally affected by such factors as distance between the jet forming nozzle and the fabric; impingement angle and pattern; the number of streams simultaneously or successively impinging given areas of the fabric; interruption or pulsation of the jet streams; and duration of the impingement. Such considerations are hereinafter referred to as jet stream characteristics and are selected and correlated in combination to provide fabric softening of at least 25%. In general, increasing the quantity and velocity of the impinging fluid increases the softening effect.

Bending modulus is used as a measure of fabric softness and is determined in accordance with techniques described in U.S. Pat. No. 3,613,445, the disclosure of which is incorporated herein by reference. In accordance with such disclosure a test fabric is forced vertically downward through a slot at a constant speed. A signal is generated in proportional response to the load incurred in moving the fabric into and through the slot. A load-extension curve is generated by plotting the signal as a function of the distance. Hand, drape and bending modulus are determined by analyzing the load-extension curve. Hand is represented by maximum point on the load-extension curve. Drape is represented by the slope of the load-deflection curve and bending modulus is determined by dividing the drape value by the cube of fabric thickness. Bending modulus is determined as an average of fabric face up and face down machine and transverse direction measurements. (Machine direction is the direction of fabric feed past the softening jets and the transverse direction is the direction, in the plane of the fabric, at a right angle thereto.)

The requirements of the present invention with respect to bending modulus and other fabric property measurements are defined in terms of relative (percent change) rather than absolute values. Accordingly, apparatus calibrations and choice of test techniques are not critical so long as reasonable consistency is maintained in a given series of comparative tests.

Since individual measurements are affected by variations in fabric uniformity and inherent limitations in the precision of various measuring techniques, it is important, in this and other fabric property determinations, to conduct and average sufficient measurements to statistically assure that the differences in values being compared fairly reflect differences in fabric properties as opposed to imprecisions or imperfect fabric uniformity.

The jet impingement may be employed, simultaneously or sequentially, in conjunction with other fabric treatments tending to effect or enhance fabric softening. For example, in processing nonwoven fabrics according to the present invention, the fabrics will frequently be subjected to jet impingements as they move along process lines wherein they are additionally passed over knife blades and/or subjected to napping or abrasive techniques and/or other mechanical stresses which may, in some cases, also effect varying degrees of fabric softening.

Thus, the effects of softening forces other than jet impingement must be considered in ensuring that the jet characteristics are correlated such that jet impingement, independently, provides the requisite softening in processing any given fabric.

In processes wherein it is feasible to obtain fabric samples prior to and subsequent to jet impingement with the fabric being subjected to no substantial softening effects other than jet impingement between the sample points, a comparison of the samples bending modulus provides a direct measure of softening attainable to the jet impingement.

If at the point of jet impingement the fabric is simultaneously subjected to severe mechanical working (e.g., agitation, beating, flexing), it is desirable to discontinue such working during the sampling. If, in the vicinity of jet impingement the fabric is passing around conveyor rolls over knife blades, or otherwise being subjected to bending or scraping forces and it is inconvenient to eliminate such forces without depriving the fabric of support and/or transport, softening due to factors other than jet impingement should be determined and accounted for. For example, samples of fabric product can be produced without jet impingement and the bending modulus of such samples compared with that of samples produced with jet impingement. The bending modulus of the unimpinged samples minus the modulus of the impinged samples will, in most cases, closely approximate the softening (reduction in bending modulus) attritable to jet impingement. In using this technique, it is noted that the presence of softening means between the sample point prior to jet impingement and the jet impingement zone will result in the calculated percent softening attributable to jet impingement being lower than the actual softening effected by the jet. So long as the calculated value is at least the requisite 25%, this error will be of no practical significance since the proper correlation of the jet characteristics remains confirmed. If further confirmation of proper jet characteristic correlation is required, such confirmation can be obtained by measuring the softness effected by otherwise equivalent impingement conditions on a fabric subjected to no other softening effect. For example, the impingement jet nozzle can be moved along a static fabric supported in the same manner as in the process impingement zone to determine softening obtained solely by jet impingement in the absence of stress induced by fabric movement.

It is not intended to attribute to the process of this invention softening effects resulting merely from removal of finishes, sizes, starch or the like from the fabric. Therefore, any such materials should be removed from the fabric, for example by soaking or passing through a bath prior to making bending modulus measurements to confirm the proper correlation of fluid jet characteristics. However, in actual fabric processing, removal of such materials prior to jet impingement is not necessary since the fluid jet may be used to remove such materials in addition to effecting the requisite softening of the fabric.

Generally it is desirable to limit the severity of the jet impingement (by control of pressure, fluid flow, contact area, contact time, etc.) so as not to reduce fabric strength by more than 50%. Preferably, strength will be reduced no more than 20%. For the purposes of this invention, strip tenacity is used as the measurement of fabric strength and is determined by dividing the breaking load (as determined by American Society of Testing Materials procedure D-1682-64) of a cut fabric strip by the fabric basis weight. Strip tenacity is reported as an average of tenacities in the machine and transverse directions as g/cm/g/m$^2$.

The required jet characteristics will be obtained by adjustment of jet nozzle design, pressure under which fluid is forced through the nozzle, and nozzle location relative to the fabric. By way of example, autogenously point-bonded continuous filament nylon 66 fabrics can generally be effectively softened by passage under jets formed by ejecting water under an upstream pressure of 30 to 150 kg/cm$^2$, preferably 42 to 70 kg/cm$^2$, through nozzles spaced from 1 to 25 cm, preferably 3 to 12 cm, from the fabric and having equivalent orifice diameters of 0.05 to 0.3 cm, preferably 0.15 to 0.20 cm. (Since orifices are frequently eliptical or of other non-round shape, the term "equivalent diameter" is used to indicate the diameter of a round orifice of equal cross sectional area.) It is noted that high pressure fluid jets of this type are capable of doing physical damage, for example, to metal screens. It is therefore quite surprising that such jets can be used to effectively soften nonwoven fabrics without severely damaging the fabric or reducing the strength thereof.

In order to avoid dissipation of jet forces through the stretching or flexing of the fabric, or shielding of the fabric from the jet forces by the formation of fluid pools, it is desirable that the fabric be supported, for example, by a moving screen or belt or by a roller or other appropriate moving or stationary surface and further that the fabric be positioned relative to the fluid jets so as to avoid the formation of fluid pools at the point of impingement.

Uniform impingement of the fabric with the fluid jet may be accomplished by movement of the jet relative to the fabric or the fabric relative to the jet. Normally a plurality of jets positioned to effect a uniform pattern of coverage of the fabric will be utilized. However, if desired, a single jet may be moved over the surface of the fabric to provide the desired impingement pattern. The jet streams may be continuous or intermittent and may be adapted to provide overall or localized softening, as desired.

In the commercial production of nonwoven fabrics it is common practice to utilize a continuous process line wherein fibers are deposited on a moving belt to form a web which is then contacted with the bonding agent and/or passed through a pair of heated rolls to effect bonding. The bonded fabric can then be passed through a bath to neutralize or remove any excess bonding agent. In a preferred embodiment of the present invention, jet impingement can be effected in such a continuous process by positioning jet impingement apparatus downstream of the bonding region. It has been found that jet softening is somewhat more effective if the jet impingement is applied to a fabric which has previously been wetted, for example by passing through a wash bath. Following impingement, the fabric can be passed through conventional drying apparatus. Further softening can then be obtained if desired by applying mechanical stress to the dried fabric, for example, by passing the fabric over a knife blade. It is surprising that additional softening can be obtained in this manner since application of such mechanical stress prior to jet impingement or subsequent to jet impingement but prior to drying of the fabric does not provide substantial additional softening as compared to the use of jet impingement alone.

The practice of the invention will be further understood from the following examples.

EXAMPLE I

Point-bonded nonwoven fabrics of continuous filament nylon 66 (autogenously bonded by the action of hydrogenchloride gas using a bossed roll to provide primary bond sites measuring about 0.5×0.5 cm, equally spaced and covering about 16% of the fabric surface) are guided over rollers through an aqueous wash bath. On exiting the bath, the fabric is passed over a roller where it is impinged with fluid jets provided by forcing water under the pressures shown in Table 1 below through nozzles having eliptical orifices of 0.16 cm equivalent diameter. A groove extending across the major axis of the orifice is cut in each nozzle face to provide a 40° fan shaped spray. The nozzles are spaced 3.75 cm apart aligned in a row transversing the path of fabric movement (nozzle grooves are aligned transverse to the direction of fabric movement) and are spaced from the fabric surface by the distances shown in the table. Fabric speed under the nozzles is 6.9 m/min.

The fabrics were dried and bending modulus measured. Percent reduction in bending modulus as compared to that of a fabric processed under otherwise equivalent conditions without fluid jet impingement is shown.

TABLE 1

| Test No. | Water Pressure Behind Nozzle kg/cm$^2$ | Nozzle to Fabric Distance cm | Reduction in Bending Modulus |
|---|---|---|---|
| 1 | 70 (1000 psi) | 5 | 80% |
| 2 | 42 (600 psi) | 5 | 74% |
| 3 | 70 (1000 psi) | 10 | 74% |
| 4 | 42 (600 psi) | 10 | 63% |

Fabric strength was not significantly affected by the foregoing treatment. It is seen from the foregoing that jet impingement effectively reduces the bending modulus and that greater reductions are observed under more severe impingement conditions.

EXAMPLE II

The procedures of Example I is repeated except that nozzles of 0.18 cm equivalent orifice diameter are utilized under the pressures shown in Table 2. In all instances the nozzles are spaced 7.6 cm from the fabric surface. In tests 4, 5 and 6, the fabric is not passed through a wash bath prior to jet impingement. Reductions in bending modulus as compared to fabric not subjected to jet impingement but otherwise equivalently processed are shown.

TABLE 2

| Test No. | Pressure Behind Nozzle kg/cm$^2$ | Reduction in Bending Modulus |
|---|---|---|
| 1 | 59 (850 psi) | 69% |
| 2 | 49 (700 psi) | 67% |
| 3 | 35 (500 psi) | 62% |
| 4 | 59 | 60% |
| 5 | 49 | 60% |
| 6 | 35 | 52% |

It is seen from the foregoing data that the effect of jet impingement is increased if the fabric is wetted, for example, by passage through a wash bath prior to jet impingement.

EXAMPLE III

The procedure of Example I is repeated using a nozzle distance from the fabric of 5 cm in all cases and the pressures shown in Table 3 below. In certain tests as indicated, following jet impingement (if utilized) and drying of the fabric, the fabric was drawn over a knife blade. Reductions in bending modulus as compared to fabrics processed without the use of jet impingement or a knife blade are shown.

TABLE 3

| Test No. | Water Pressure ($kg/cm^2$) | Knife Blade | Reduction in Bending Modulus |
|---|---|---|---|
| 1 | 70 | no | 85% |
| 2 | 70 | yes | 88% |
| 3 | 59 | no | 80% |
| 4 | 59 | yes | 84% |
| 5 | 49 | no | 76% |
| 6 | 49 | yes | 81% |
| 7 | no impingement | yes | 63% |

The foregoing examples and description of the preferred embodiments will enable those skilled in the art to practice these and all other embodiments of the invention within the scope of the appended claims.

What is claimed is:

1. A process for softening a softenable, bonded nonwoven fabric said process being characterized in that said fabric is impinged with a fluid jet having jet characteristics correlated to effect at least a twenty-five percent reduction in bending modulus of said fabric.

2. A process according to claim 1 further characterized in that said fabric is a point-bonded fabric and the fluid jet is a water jet.

3. A process according to claim 2 further characterized in that said fabric is composed of continuous nylon filaments and is autogenously bonded.

4. A process according to claim 3 further characterized in that the jet characteristics are correlated to effect at least a fifty percent reduction in fabric bending modulus and less than a 50% reduction in fabric strip tenacity.

5. A process for softening an autogenously point-bonded, nonwoven, continuous filament nylon fabric, said process being characterized in that said fabric is impinged with a fluid jet formed by ejecting water under a pressure of from 30 to 150 $kg/cm^2$ through a nozzle having an equivalent orifice diameter of from 0.05 to 0.3 cm, said nozzles being spaced from the fabric surface by a distance of 3 to 12 cm and being disposed to effect impingement of a major portion of the fabric surface.

6. A process according to claim 5 further characterized by wetting said fabric prior to jet impingement thereof.

7. A process according to claim 6 further characterized by drying said fabric subsequent to jet impingement thereof and drawing the dried fabric over a sharply angled surface.

* * * * *